US011664155B2

(12) United States Patent
Igarashi et al.

(10) Patent No.: US 11,664,155 B2
(45) Date of Patent: May 30, 2023

(54) COIL COMPONENT

(71) Applicant: Murata Manufacturing Co., Ltd., Kyoto-fu (JP)

(72) Inventors: Akio Igarashi, Nagaokakyo (JP); Yuuji Igarashi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 472 days.

(21) Appl. No.: 16/292,016

(22) Filed: Mar. 4, 2019

(65) Prior Publication Data

US 2019/0287715 A1 Sep. 19, 2019

(30) Foreign Application Priority Data

Mar. 17, 2018 (JP) ..... JP2018-050280

(51) Int. Cl.
*H01F 17/04* (2006.01)
*H01F 27/32* (2006.01)
*H01F 27/28* (2006.01)

(52) U.S. Cl.
CPC ..... *H01F 27/323* (2013.01); *H01F 27/2823* (2013.01)

(58) Field of Classification Search
CPC ..... H01F 17/045; H01F 2017/0093
USPC ..... 336/221
See application file for complete search history.

(56) References Cited

U.S. PATENT DOCUMENTS

| | | | | |
|---|---|---|---|---|
| 7,201,344 | B2 * | 4/2007 | Higeta | H01F 41/086 242/444.4 |
| 2005/0255741 | A1 | 11/2005 | Ashida et al. | |
| 2006/0033603 | A1 * | 2/2006 | Hirai | H01F 17/045 336/200 |
| 2008/0055034 | A1 * | 3/2008 | Tsunemi | H01F 3/10 336/83 |
| 2014/0354394 | A1 * | 12/2014 | Oya | B05D 3/0254 336/222 |
| 2015/0248963 | A1 * | 9/2015 | Inaba | H01F 37/00 363/131 |
| 2016/0118184 | A1 * | 4/2016 | Ukai | H01F 17/045 336/192 |
| 2017/0011844 | A1 * | 1/2017 | Mikogami | H01F 41/127 |
| 2017/0062122 | A1 * | 3/2017 | Kanbe | H01F 27/2823 |

FOREIGN PATENT DOCUMENTS

| | | | |
|---|---|---|---|
| JP | S63-19709 | A | 1/1988 |
| JP | H06-104135 | A | 4/1994 |
| JP | H06-224064 | A | 8/1994 |
| JP | 2001-015353 | A | 1/2001 |
| JP | 2003-068558 | A | 3/2003 |
| JP | 2004-342541 | A | 12/2004 |
| JP | 2006-253394 | A | 9/2006 |

(Continued)

OTHER PUBLICATIONS

English translation of JP2003068558 (Year: 2003).*

(Continued)

*Primary Examiner* — Ronald Hinson
(74) *Attorney, Agent, or Firm* — Studebaker & Brackett PC

(57) ABSTRACT

A coil component includes a blocking material that contains a resin and that blocks a route that leads to a gap between turns of a wire from an outside at portions of the wire that are in close contact with each other between adjoining turns.

20 Claims, 3 Drawing Sheets

(56) References Cited

FOREIGN PATENT DOCUMENTS

| | | | |
|---|---|---|---|
| JP | 2013-062477 | A | 4/2013 |
| JP | 2017-022372 | A | 1/2017 |
| WO | 2004/015822 | A1 | 2/2004 |

OTHER PUBLICATIONS

English translation of JP2008186996 (Year: 2008).*
An Office Action; "Notification of Reasons for Refusal," mailed by the Japanese Patent Office dated Jun. 30, 2020, which corresponds to Japanese Patent Application No. 2018-050280 and is related to U.S. Appl. No. 16/292,016 with English language translation.
An Office Action; "Notice of Reasons for Refusal," mailed by the Japanese Patent Office dated Jan. 26, 2021, which corresponds to Japanese Patent Application No. 2018-050280 and is related to U.S. Appl. No. 16/292,016 with English language translation.
Satogawa Takaomi et al.; "Plastic Materials Course Fluororesins"; Nikkan Kogyo Shimbun; Oct. 31, 1969; first edition; total 6 pages; Japan.
Electrical Materials; Institute of Electrical Engineers of Japan University Course; 15th edition; Sep. 30, 1958; vol. 1; pp. 228; Japan.
Miyashita Tokuji; "Compact Polymer Chemistry—Centered on an Explanation of Functional Polymer Materials"; Apr. 10, 2013; first edition, pp. 16; Sankyo Printing Co., Ltd.; Japan.

* cited by examiner

COIL COMPONENT

CROSS-REFERENCE TO RELATED APPLICATION

This application claims benefit of priority to Japanese Patent Application No. 2018-050280, filed Mar. 17, 2018, the entire content of which is incorporated herein by reference.

BACKGROUND

Technical Field

The present disclosure relates to a coil component, and more particularly to a coil component including at least a wire that is helically wound such that the wire has a number of turns, and that includes portions in close contact with each other between adjoining turns.

Background Art

An existing coil component is disclosed in, for example, Japanese Unexamined Patent Application Publication No. 2017-22372. This coil component is obtained by performing the following processes: a wire having a three-layer structure of a core material, a covering film, and a resin film is helically wound around a winding core portion such that the wire has a number of turns, and subsequently, the resin film is melted by a heat treatment to form a resin covering layer that is infiltrated into gaps between the turns of the wound wire. According to Japanese Unexamined Patent Application Publication No. 2017-22372, the wire is thus covered by the resin covering layer. Japanese Unexamined Patent Application Publication No. 2017-22372 discloses that the coil component, which is required to have a high dielectric withstand voltage as a pulse transformer is required, can ensure a sufficient dielectric withstand voltage.

SUMMARY

In the coil component disclosed in Japanese Unexamined Patent Application Publication No. 2017-22372, there is always a meaningful distance between the turns of the wire, which is helically wound such that the wire has a number of the turns, with the resin covering layer interposed therebetween because of a manufacturing method thereof and the purpose to ensure the dielectric withstand voltage. Specifically, in the case where the wire has a low insulation performance even partly between the turns, the dielectric withstand voltage cannot be ensured when there is a large difference in voltage. Accordingly, it is always necessary for all gaps between the turns of the wire to be filled with the resin covering layer. The wire that has been covered by the resin film, which is to be melted and becomes the resin covering layer, is wound, and accordingly, the distance between the turns is at least equal to or more than the thickness of the resin film.

In the case of a coil component for use in a signal system such as a balun or a common mode choke coil instead of a power system such as the pulse transformer, decrease in size and decrease in characteristic variation are emphasized rather than the dielectric withstand voltage, the distance between the turns of the wire is very narrow, and portions of the wire are substantially in close contact with each other between the turns in some cases. In these cases, the resin covering layer as disclosed in Japanese Unexamined Patent Application Publication No. 2017-22372 cannot be used.

The present inventors have found that the coil component has a new problem in the case where the wire includes portions in close contact with each other between the turns as above.

Specifically, in some cases, an entire printed circuit board that is equipped with electronic components including a coil component is coated with a resin coating material to protect the printed circuit board from water. In the case where the coil component includes no resin covering layer, the coating material flows into the gaps between the turns of the wire, and this arises a phenomenon in which the coating material adheres to the circumference of the wire. In this case, at the portions of the wire that are in close contact with each other between the adjoining turns, a stray capacitance between the turns of the wire greatly increases or decreases depending on the physical properties of the coating material and a state of the coating material that adheres to the wire. In particular, there is a problem in that high-frequency characteristics, which are important for the coil component for use in the signal system, vary.

The present disclosure provides a coil component in which the coating material is unlikely to flow into the portions of the wire that are in close contact with each other.

According to preferred embodiments of the present disclosure, a coil component includes a wire that includes an insulating film, that is helically wound such that the wire has a number of turns, and that includes portions in close contact with each other between adjoining turns, and a blocking material that contains a resin and that blocks a route that leads to a gap between the turns of the wire from an outside at the portions in close contact with each other. The expression "adjoining turns" is used not only in the case where the turns, for example, the n-th turn and the (n+1)-th turn are adjacent to each other with a single wire wound but also in the case where a specific turn of a first wire and a specific turn of a second wire, for example, are adjacent to each other with two or more wires wound.

The gap between the turns of the wire is preferably filled with the blocking material. With this structure, a coating material can be perfectly or substantially perfectly prevented from flowing into the gap between the turns of the wire.

The blocking material may adhere to a surface portion of the wire. The surface portion of the wire corresponds to the boundary between the wire and the outside. Accordingly, this structure enables the route that leads to the gap between the turns of the wire from the outside to be effectively blocked.

The portions of the wire that are in close contact with each other between the adjoining turns preferably extend over at least one of the turns. The reason is that the coating material that flows into the portions of the wire that are in close contact with each other greatly affects a stray capacitance.

A dielectric constant of the blocking material is preferably lower than a dielectric constant of the insulating film. This structure inhibits increase in a stray capacitance due to the blocking material.

According to one embodiment of the present disclosure, a relative dielectric constant of the blocking material is more preferably 2.2 or less. Since the relative dielectric constant of a typical coating material is 4 or more, the stray capacitance can be surely lower than that in the case where the coating material flows into the portions even when there is the blocking material at the portions of the wire that are in close contact with each other between any turns.

According to the preferred embodiments of the present disclosure, the blocking material is preferably composed of a foamable resin. With this structure, the substantial dielectric constant of the blocking material having spaces therein is decreased because gas is contained. Accordingly, the dielectric constant at locations between the turns of the wire can be decreased even when the dielectric constant of the resin, which is a base, is high. Accordingly, choices of resins that can be used as the material of the blocking material can be increased. The behavior of thermal expansion of the blocking material is the same as the behavior of thermal expansion of the resin itself, which is the base thereof, and accordingly, a thermal stress that is applied to the wire can be equal to a thermal stress in the case where the blocking material contains no gas.

The resin of which the blocking material is composed preferably contains an epoxy resin that causes a solidification reaction due to amines, imidazoles, or acid anhydrides. With this structure, the blocking material can be solid and accordingly makes the winding of the wire unlikely to collapse and deform.

A melting point of the blocking material is preferably 125° C. or more. With this structure, the blocking material can withstand high temperatures of more than 100° C., and consequently, the reliability of the coil component can be improved.

According to preferred embodiments of the present disclosure, the blocking material makes the coating material unlikely to flows into the portions of the wire that are in close contact with each other.

Other features, elements, characteristics and advantages of the present disclosure will become more apparent from the following detailed description of preferred embodiments of the present disclosure with reference to the attached drawings.

DETAILED DESCRIPTION

Figure 1:
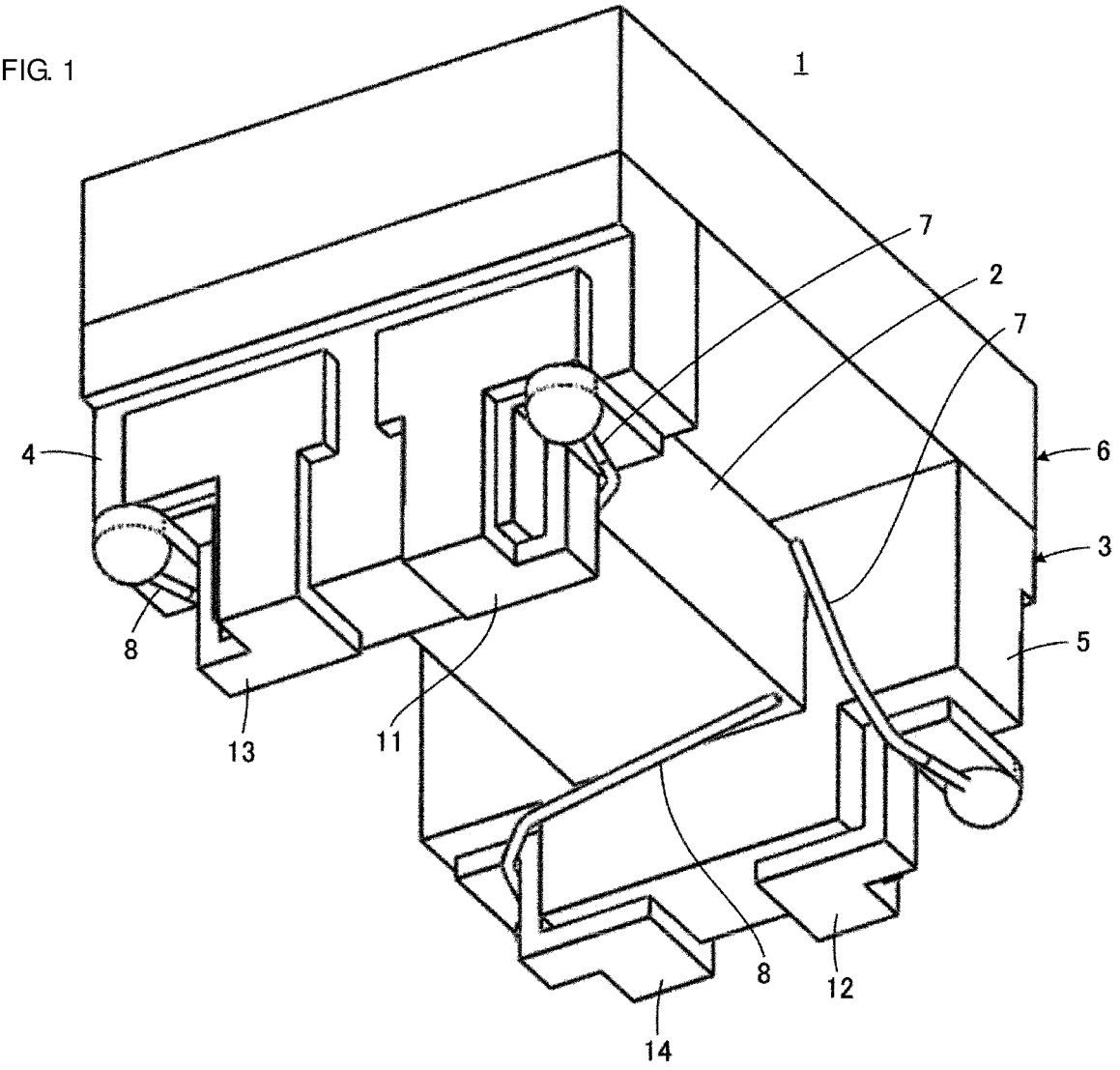
FIG. 1 is a perspective view of a coil component according to a first embodiment of the present disclosure and illustrates the appearance thereof from a mounting surface side, where an illustration of the windings of wires is omitted.

A coil component 1 according to a first embodiment of the present disclosure will be described with reference to FIG. 1 and FIG. 2. The coil component 1 forms, for example, a common mode choke coil.

The coil component 1 includes a drum-shaped core 3 including a winding core portion 2. The drum-shaped core 3 includes first and second flange portions 4 and 5 that are mounted on first and second end portions of the winding core portion 2 that are opposite each other. The coil component 1 may include a plate core 6 that extends over the first and second flange portions 4 and 5. The drum-shaped core 3 and the plate core 6 are composed of a nonconductive material, for example, a non-magnetic material such as alumina, a magnetic material such as ferrite, or a resin.

The above plate core 6 adheres to the first and second flange portions 4 and 5 with an adhesive. A curable resin such as an epoxy resin can be used as the adhesive. Amines, imidazoles, or acid anhydrides are preferably used as a curing agent for the curable resin.

The coil component 1 includes first and second wires 7 and 8 that are helically wound around the winding core portion 2. In FIG. 1, end portions of the wires 7 and 8 are illustrated, but an illustration of portions of the wires 7 and 8 on or above the winding core portion 2 is omitted. As illustrated in FIG. 2, the wires 7 and 8 each include a linear, central conductor 9 and an insulating film 10 that covers the circumferential surface of the central conductor 9. The central conductor 9 is formed of, for example, a copper wire. The insulating film 10 is formed of, for example, a resin such as polyamide imide or polyurethane.

The first and second wires 7 and 8 are wound in the same direction in parallel. At this time, as illustrated in FIG. 2, the wires 7 and 8 are wound so as to form two layers such that any one of the wires 7 and 8, for example, the first wire 7 is wound on an inner layer side and the other wire, for example, the second wire 8 is wound on an outer layer side.

The coil component 1 also includes first to fourth terminal electrodes 11 to 14. Among the first to fourth terminal electrodes 11 to 14, the first and third terminal electrodes 11 and 13 are mounted on the first flange portion 4, and the second and fourth terminal electrodes 12 and 14 are mounted on the second flange portion 5. The terminal electrodes 11 to 14 are manufactured from a metallic plate that is composed of a copper alloy such as phosphor bronze or tough pitch copper.

A first end of the above first wire 7 is electrically connected to the first terminal electrode 11. A second end of the first wire 7 opposite the first end is electrically connected to the second terminal electrode 12. A first end of the second wire 8 is electrically connected to the third terminal electrode 13. A second end of the second wire 8 opposite the first end is electrically connected to the fourth terminal electrode 14. The wires 7 and 8 are connected to the terminal electrodes 11 to 14 by, for example, thermal welding or laser welding.

Characteristic structures according to the present embodiment will now be described with reference to mainly FIG. 2.

The wires 7 and 8 that are helically wound around the winding core portion 2 each include portions in close contact with each other between adjoining turns. In the range illustrated in FIG. 2, the portions of each of the wires 7 and 8 are in close contact with each other between the adjoining turns with respect to all of the turns. Accordingly, the portions of each of the wires 7 and 8 that are in close contact with each other between the adjoining turns satisfy a condition that the portions extend over at least one of the turns. A blocking material 15 that contains a resin is disposed at the portions of each of the wires 7 and 8 that are in close contact with each other between the adjoining turns. The blocking material 15 is typically disposed in a manner in which the windings of the wires 7 and 8 are dipped into the resin.

The blocking material 15 blocks a route that leads to gaps 16 between the turns of the wires 7 and 8 from the outside. To fulfill this function, the gaps 16 between the turns of the wires 7 and 8 are preferably filled with the blocking material 15. With this structure, a coating material (not illustrated) can be perfectly or substantially perfectly prevented from flowing into the gaps 16 in a subsequent process because the gaps 16 are already filled with the blocking material 15. In addition, as shown in FIG. 2, for example, in a region in which the blocking material 15 is disposed, an uppermost surface of the wire 8 may be exposed through the blocking material 15.

The blocking material 15 may adhere to a surface portion 17 or 18 of the wire 7 or 8. The surface portions 17 and 18 of the wires 7 and 8 mean the outer surfaces of the wires 7 and 8 and the vicinity thereof. The surface portion 17 or 18 of the wire 7 or 8 corresponds to the boundary between the wire 7 or 8 and the outside. Accordingly, this structure enables the route that leads to the gaps 16 between the turns of the wires 7 and 8 from the outside to be effectively blocked.

Figure 2:
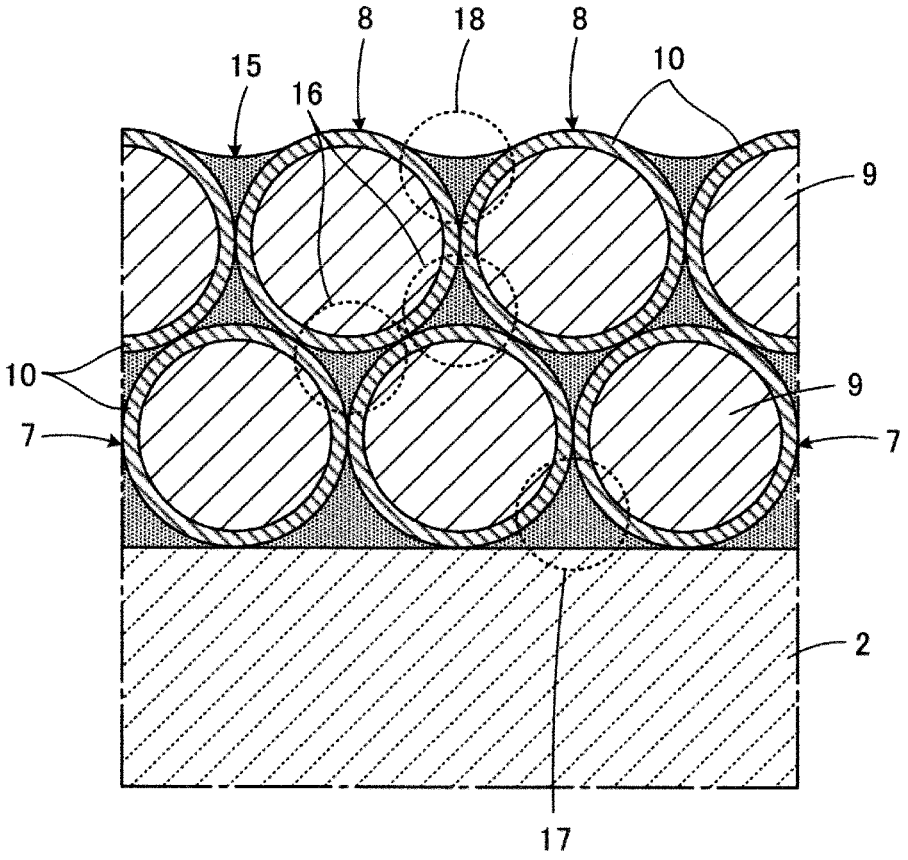
FIG. 2 is an enlarged sectional view of parts of the windings of the wires that the coil component illustrated in FIG. 1 includes.

As illustrated in FIG. 2, the surface portion 17 of the wire 7 on the lower layer side is already covered by the winding core portion 2. However, even in some cases where the surface portion is thus covered by the winding core portion 2, the coating material flows into the gaps 16. More specifically, there is a possibility that the portions of the wire 7 on the lower layer side are in close contact with each other between the adjoining turns with a relatively low degree and/or the wire 7 on the lower layer side and the winding core portion 2 are in close contact with each other with a relatively low degree. Both ends of the winding of the wire 7 on the lower layer side are likely to be released toward the flange portions 4 and 5. The present disclosure includes a coil component that does not include the winding core portion 2 and/or the drum-shaped core 3.

For these reasons, in some cases where the blocking material 15 is not disposed with respect to the surface portion 17 of the wire 7 on the lower layer side, the coating material flows into the gaps 16. Accordingly, the blocking material 15 is preferably disposed also with respect to the surface portion 17 of the wire 7 on the lower layer side.

It is only necessary for the blocking material 15 to fulfill the function of blocking the route that leads to the gaps 16 between the turns of the wires 7 and 8 from the outside. Accordingly, the blocking material 15 does not necessarily adhere to the surface portions 17 and 18 provided that the gaps 16 are filled with the blocking material. Alternatively, the gaps 16 are not necessarily filled with the blocking material 15 provided that the blocking material 15 adheres to the surface portions 17 and 18.

The dielectric constant of the blocking material 15 is preferably lower than the dielectric constant of the insulating film 10 of each of the wires 7 and 8. This structure inhibits increase in a stray capacitance due to the blocking material 15. For example, when the insulating film 10 is composed of polyamide imide (the relative dielectric constant is about 3.8 to 4.1), the blocking material 15 is preferably composed of a fluorine resin (the relative dielectric constant is about 2.1 to 2.8). For example, when the insulating film 10 is composed of polyurethane (the relative dielectric constant is about 5.0 to 5.3), the blocking material 15 is preferably composed of an epoxy resin (the relative dielectric constant is about 3.5 to 5.0).

In the structure disclosed in Japanese Unexamined Patent Application Publication No. 2017-22372, an insulating resin with which the gaps between the turns of the wire are filled has a high density to prevent dielectric breakdown from occurring and has a high relative dielectric constant. Accordingly, the technique disclosed in Japanese Unexamined Patent Application Publication No. 2017-22372 has a problem in that the insulating resin increases the stray capacitance and degrades the high-frequency characteristics of the coil component. This problem is more serious particularly for the application to an automotive ethernet (registered trademark), which is strictly required to have the high-frequency characteristics. In contrast, in the case where the dielectric constant of the blocking material 15 is lower than the dielectric constant of the insulating film 10 of each of the wires 7 and 8 as described above, the problem can be solved.

When the blocking material 15 is composed of an epoxy resin, amines, imidazoles, or acid anhydrides are preferably used as the curing agent as described above. The blocking material 15 composed of an epoxy resin that causes a solidification reaction due to such a curing agent is solid and accordingly makes the windings of the wires 7 and 8 unlikely to collapse and deform.

The relative dielectric constant of the blocking material 15 is more preferably 2.2 or less. Since the relative dielectric constant of a typical coating material is 4 or more, the stray capacitance can be greatly decreased even when there is the blocking material 15 at the portions of the wires 7 and 8 that are in close contact with each other between any turns. A known low dielectric constant material such as fluorine resin described above is favorably used as the material of the blocking material 15 that has a relative dielectric constant of 2.2 or less.

The blocking material 15 can be composed of a foamable resin because the dielectric constant of the blocking material 15 is lower than the dielectric constant of the insulating film 10 and/or the relative dielectric constant of the blocking material 15 is 2.2 or less. The foamable resin is a composite material of a resin and a gas, and accordingly, the dielectric constant of the blocking material 15 can be decreased even when the dielectric constant of the resin, which is a base, is high. Accordingly, choices of resins that can be used as the material of the blocking material 15 can be increased. The behavior of thermal expansion of the blocking material 15 is the same as the behavior of thermal expansion of the resin itself, which is the base thereof, and accordingly, a thermal stress that is applied to the wires 7 and 8 can be equal to a thermal stress in the case where the blocking material 15 contains no gas.

The melting point of the blocking material 15 is preferably 125° C. or more, and more preferably 150° C. or more. With this structure, the blocking material 15 appropriately functions even in the case where a high-temperature environment is assumed, for example, for the application to a vehicle. Consequently, the reliability of the coil component 1 can be improved.

According to the first embodiment described above, as illustrated in FIG. 2, the most portions of the wires 7 and 8 other than portions that are pulled to the terminal electrodes 11 to 14 illustrated in FIG. 1 are in close contact with each other between the adjoining turns. More specifically, the wires 7 and 8 are wound so as to form the two layers such that the first wire 7 is wound on the inner layer side and the second wire 8 is wound on the outer layer side. The portions of the first wire 7 are in close contact with each other between the adjoining turns, the portions of the second wire 8 are in close contact with each other between the adjoining turns, and the portions of the first wire 7 and the corresponding portions of the second wire 8 are in close contact with each other between the turns of the first wire 7 and the second wire 8 that are adjacent to each other.

According to a modification to the first embodiment, the first and second wires 7 and 8 may be wound in a bifilar winding manner such that the first and second wires 7 and 8 are arranged so as to alternate in the axial direction of the winding core portion 2 and so as to be parallel to each other and may be wound, for example, so as to form two layers, although this is not illustrated. Also, in this case, the portions of the first wire 7 can be in close contact with each other between the adjoining turns, the portions of the second wire 8 can be in close contact with each other between the adjoining turns, and the portions of the first wire 7 and the corresponding portions of the second wire 8 can be in close contact with each other between the turns of the first wire 7 and the second wire 8 that are adjacent to each other.

The following description includes other examples of the state where portions of at least a single wire are in close contact with each other between the adjoining turns. The adjoining turns mean not only that the turns are adjacent to each other with a single wire wound but also that the turns of a wire and the turns of another wire are adjacent to each other with two or more wires wound.

Figure 3:
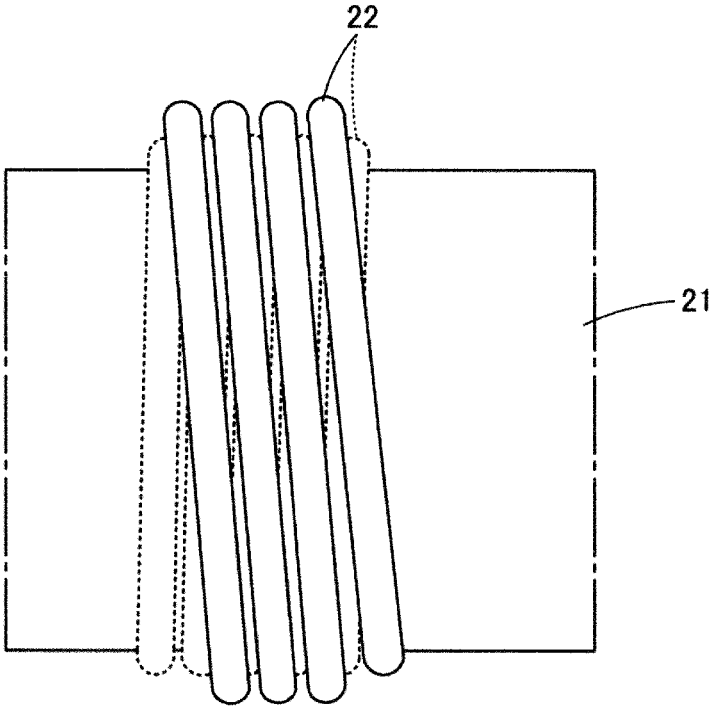
FIG. 3 illustrates a second embodiment of the present disclosure and illustrates a wire that is wound around a winding core portion such that the wire forms two layers.

FIG. 3 illustrates a second embodiment of the present disclosure and illustrates a wire 22 that is wound around a winding core portion 21 such that the wire forms two layers. In FIG. 3, a lower-layer-side portion of the wire 22 that is wound is illustrated by dashed lines, and an upper-layer-side portion thereof is illustrated by solid lines to clearly distinguish between the lower layer side and the upper layer side of the wire 22 that forms the two layers in the figure.

The wire 22 includes no portions that are in close contact with each other between the adjoining turns on the lower layer side or between the adjoining turns on the upper layer side. According to the present embodiment, the wire 22 includes portions that are in close contact with each other between the turns on the lower layer side and the turns on the upper layer side. More specifically, portions of the wire 22 at which the turns on the lower layer side intersect the turns on the upper layer side are in close contact with each other. Accordingly, the blocking material is disposed so as to block the route that leads to the gaps between the turns from the outside at the portions in close contact with each other, although this is not illustrated. In this case, the blocking material may be disposed so as to cover the entire wire 22 that is wound.

In the above description, FIG. 3 illustrates the wire 22 that is wound around the winding core portion 21 such that the wire forms the two layers. However, two wires may be wound around the winding core portion 21 such that one of the wires is on the lower layer side and the other wire is on the upper layer side.

Figure 4:
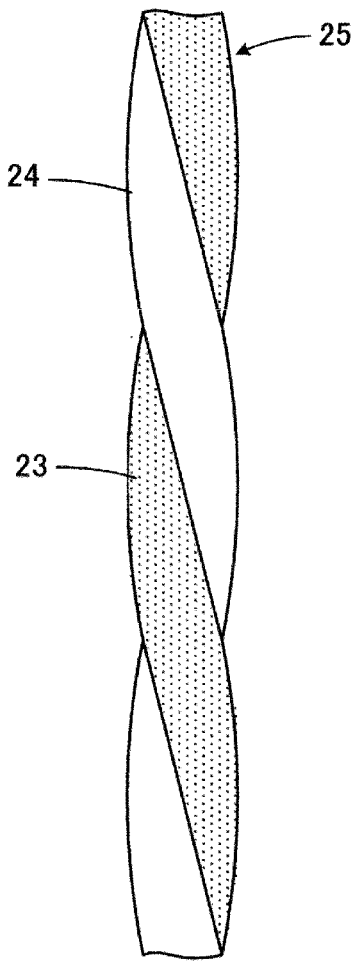
FIG. 4 illustrates a third embodiment of the present disclosure and illustrates an enlarged view of a stranded wire in which two wires that are to be wound are stranded.

FIG. 4 illustrates a third embodiment of the present disclosure and illustrates a stranded wire 25 in which two wires 23 and 24 that are to be wound are stranded. In FIG. 4, the first wire 23 is hatched and the second wire 24 is outlined to clearly distinguish the first wire 23 and the second wire 24 in the figure.

In the case where the stranded wire 25 that is formed of the first wire 23 and the second wire 24 is helically wound such that the stranded wire has a number of the turns, the first wire 23 and the second wire 24 form portions that are in close contact with each other between the adjoining turns within the stranded wire 25, regardless of whether there are any portions that are in close contact with each other between the adjoining turns of the stranded wire 25 itself. Accordingly, the blocking material is disposed so as to block the route that leads to the gaps between the turns from the outside at the portions of the first wire 23 and the second wire 24 that are in close contact with each other between the adjoining turns within the stranded wire 25, although this is not illustrated. In this case, the blocking material is typically disposed so as to cover the entire stranded wire 25 that is wound.

The present disclosure is described above with the embodiments illustrated. Other various modifications can be made.

For example, according to a modification to the embodiments illustrated, the wire may be wound so as to form a single layer or three or more layers.

According to the first and third embodiments, each coil component includes the two wires. However, the number of the wires, the direction in which each wire is wound, and the number of the terminal electrodes, for example, can be changed in accordance with the function of the coil component.

Each terminal electrode may not be composed of a metallic plate but may be composed of plating or conductive paste.

A coil component according to an embodiment of the present disclosure may not include the winding core portion and/or the drum-shaped core as described above.

The above embodiments are described by way of example. The features can be partially replaced and combined between the different embodiments.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a wire that includes an insulating film, is helically wound such that the wire has a number of turns, and includes portions in close contact with each other between adjoining turns;

a drum-shaped core around which the wire is wound;

a plate core arranged outside the wire and bonded to the drum-shaped core; and a blocking material that contains a resin and blocks a route that leads to a gap between the turns of the wire from an outside at the portions in close contact with each other, wherein, between adjoining turns of the wire, an outermost surface of the blocking material has a concave shape, and in a region in which the blocking material is disposed, an uppermost surface of the wire is exposed through the blocking material.

2. The coil component according to claim 1, wherein the resin of which the blocking material is composed contains an epoxy resin that causes a solidification reaction due to amines, imidazoles, or acid anhydrides.

3. The coil component according to claim 1, wherein a melting point of the blocking material is 125° C. or more.

4. The coil component according to claim 1, wherein the gap between the turns of the wire is filled with the blocking material.

5. The coil component according to claim 4, wherein the blocking material adheres to a surface portion of the wire.

6. The coil component according to claim 4, wherein the portions in close contact with each other extend over at least one of the turns.

7. The coil component according to claim 4, wherein a dielectric constant of the blocking material is lower than a dielectric constant of the insulating film.

8. The coil component according to claim 4, wherein the resin of which the blocking material is composed contains an epoxy resin that causes a solidification reaction due to amines, imidazoles, or acid anhydrides.

9. The coil component according to claim 1, wherein the blocking material adheres to a surface portion of the wire.

10. The coil component according to claim 9, wherein the portions in close contact with each other extend over at least one of the turns.

11. The coil component according to claim 9, wherein a dielectric constant of the blocking material is lower than a dielectric constant of the insulating film.

12. The coil component according to claim 9, wherein the resin of which the blocking material is composed contains an epoxy resin that causes a solidification reaction due to amines, imidazoles, or acid anhydrides.

13. The coil component according to claim 1, wherein the portions in close contact with each other extend over at least one of the turns.

14. The coil component according to claim 13, wherein a dielectric constant of the blocking material is lower than a dielectric constant of the insulating film.

15. The coil component according to claim 1, wherein a dielectric constant of the blocking material is lower than a dielectric constant of the insulating film.

16. The coil component according to claim 15, wherein the blocking material is composed of a foamable resin.

17. The coil component according to claim 15, wherein a relative dielectric constant of the blocking material is 2.2 or less.

18. The coil component according to claim 17, wherein the blocking material is composed of a foamable resin.

19. The coil component according to claim 1, wherein the wire is helically wound in a first layer and a second layer on an outer side of the first layer, and at least one turn of the wire in the second layer is in close contact with at least three turns of the wire in the first layer.

20. The coil component according to claim 19, wherein plural turns of the wire in the second layer are in close contact with at least three turns of the wire in the first layer.

* * * * *